United States Patent [19]

Taniguchi et al.

[11] Patent Number: 5,046,715

[45] Date of Patent: Sep. 10, 1991

[54] PAPER FEEDING APPARATUS FOR IMAGE FORMING MACHINE

[75] Inventors: Tadasu Taniguchi; Yuji Sugimoto; Ken-ichi Iwamoto, all of Nara, Japan

[73] Assignee: Sharp Kabushiki Kaisha, Osaka, Japan

[21] Appl. No.: 511,191

[22] Filed: Apr. 19, 1990

[30] Foreign Application Priority Data

May 13, 1989 [JP] Japan ..... 1-119771

[51] Int. Cl.[5] ..... B65H 1/22

[52] U.S. Cl. ..... 271/164; 271/241

[58] Field of Search ..... 271/162, 164, 145, 426, 271/241

[56] References Cited

U.S. PATENT DOCUMENTS 3,563,535 2/1971 Vitu et al. ..... 271/164

4,861,017 8/1989 Yamamoto et al. ..... 271/162

FOREIGN PATENT DOCUMENTS 139833 6/1988 Japan ..... 271/164

*Primary Examiner*—H. Grant Skaggs

[57] ABSTRACT

A paper feeding apparatus is provided with a paper feed roller supported rotatably by an image forming system body via a roller shaft, a paper feeding table which can be drawn freely in the axial direction of the roller shaft from a paper feed opening of the image forming machine body, a paper feeding hopper guided and supported by the paper feeding table so as to be movable freely to and from the paper feed roller horizontally, and in a direction orthogonal to the axial direction of the roller shaft, and an interlocking device which moves the paper feeding hopper freely to and from the paper feed roller in an interlocking motion with the drawing and restoring operation of the paper feeding table. Thereby, when the paper feeding table moves backward from the front, the paper feeding hopper is moved to the side of the paper feed roller along guide rails by the interlocking device. Then, the paper feed roller is rotated and the paper feeding hopper is received in a predetermined position without slacking of the paper.

13 Claims, 5 Drawing Sheets

PAPER FEEDING APPARATUS FOR IMAGE FORMING MACHINE

BACKGROUND OF THE INVENTION

1. Field of the Invention

The present invention relates to a paper feeding apparatus for an image forming machine such as a copying machine or a laser printer.

2. Description of the Prior Art

In a conventional copying machine, in a place where the lateral width of the copying machine body is restricted for installation, in order to insert or to take out a paper feeding hopper 3 such as a paper feeding cassette from the front side (right side in FIG. 1), a so-called front loading cassette type has been employed, wherein, as shown in FIG. 1, the paper feeding hopper 3 such as the paper feeding cassette is inserted and taken out freely from the axial direction 61 of a roller shaft 2 of a paper feed roller 2 relative to the paper feed roller 1 supported rotatably by the image forming machine body. Papers 4 are biased upward by means of springs 22.

In the prior art aforementioned, when the paper feeding hopper 3 placed on a drawer is used as it is, as shown in FIG. 1, the papers 4 are moved in parallel to the axial direction 61 of the paper feed roller 1 and caught by the paper feed roller 1 as shown by reference numeral 4*a*, thus causing a slack in the paper feeding hopper 3 and jamming during feeding of the paper.

Also, such a problem is encountered that a paper feeding hopper for a drawing mechanism has to be newly designed, resulting in high cost.

SUMMARY OF THE INVENTION

In view of the above circumstances, it is an object of the present invention to provide a paper feeding apparatus for an image forming machine, in which an existing paper feeding hopper is utilized and jamming during opening and closing of a drawer of a paper feeding table can be prevented.

In the invention, as means for solving the problems, as shown in FIGS. 2 and 4, there are provided a paper feed roller 13 supported rotatably by an image forming system body 11 via a roller shaft 12, a paper feeding table 15 which can be drawn freely in the axial direction of the roller shaft 12 from a paper feed opening 14 of the image forming machine body 11, a paper feeding hopper 16 guided and supported by the paper feeding table 15 so as to be movable freely to and from the paper feed roller 13 horizontally, and in a direction orthogonal to the axial direction of the roller shaft 12, and interlocking means 17 which moves the paper feeding hopper 16 freely to and from the paper feed roller 13 in an interlocking motion with the drawing and restoring operation of the paper feeding table 15.

In the means for solving the problems aforementioned, when the paper feeding table 15 moves backward from the front, the paper feeding hopper 16 is moved to the side of the paper feed roller 13 along guide rails 19, 20 by the interlocking means 17. Then, the paper feed roller 13 is rotated and the paper feeding hopper 16 is received in a predetermined position without slacking of the paper.

Accordingly, the existing paper feeding hopper may be utilized and jamming can be prevented during opening and closing of a drawer of the paper feeding hopper.

Also, the interlocking means 17 of the invention comprises,

- a first link 28 having one end pivoted swingably to the paper feeding table 15 by a first pin 27 which is vertical respectively to the axial direction 61 and the orthogonal direction 60 of a roller shaft,
- a second link 25 having one end pivoted swingably to the other end of the first link 28 by a second pin 26 parallel to the first pin 27, and the other end pivoted swingably by a third pin 24 parallel to the first pin 27; and
- a stopper 30 which prevents the other end of the first link 28 and the one end of the second link 25 from being inserted and displaced in a direction parallel to the axial direction 61 of the roller shaft.

Further, the interlocking means 17 of the invention comprises,

- a moving member 43 provided on the paper feeding table 15 displaceably in parallel to the axial direction 61 of the roller shaft,
- a fixed pulley 44 installed on the paper feeding table 15,
- movable pulleys 51, 52 provided displaceably on the paper feeding table 15 in parallel to the axial direction 61 of the roller shaft;
- a first wire 48 connected at one end to the moving member 43 and to one of the movable pulleys 51, 52 at the other end;
- a second wire 50 connected at one end to the paper feeding table 15 and to a portion of the paper feeding hopper close to the paper feed roller at the other end; and
- a stopper 30 which prevents the moving member 43 from being inserted and displaced in parallel to the axial direction 61 of the roller shaft.

As it will be apparent from the description aforementioned, according to the invention, since there are provided a paper feeding roller supported rotatably to an image forming machine body via a roller shaft, a paper feeding table freely drawn out in the axial direction of the roller shaft from a paper feed opening, a paper feeding hopper guided and supported by the paper feeding table so as to be movable freely to and from the paper feed roller horizontally and in a direction orthogonal to the axial direction of the roller shaft, and interlocking means which moves the paper feeding hopper freely to and from the paper feed roller in an interlocking motion with the drawing and restoring operation of the paper feeding table, the paper hopper is moved in the axial and vertical direction of the paper feed roller, so that the paper feeding hopper may be received in a predetermined position without twisting of paper, thus it is very efficacious in preventing the paper feed roller from hitting the paper feeding hopper.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Others and further objects, features and advantages of the invention will be more explicit from the following detailed description taken with reference to the drawings which are given by way of illustration only, and thus are not limitative of the present invention, and wherein.

DESCRIPTION OF THE PREFERRED EMBODIMENTS

Figure 1:
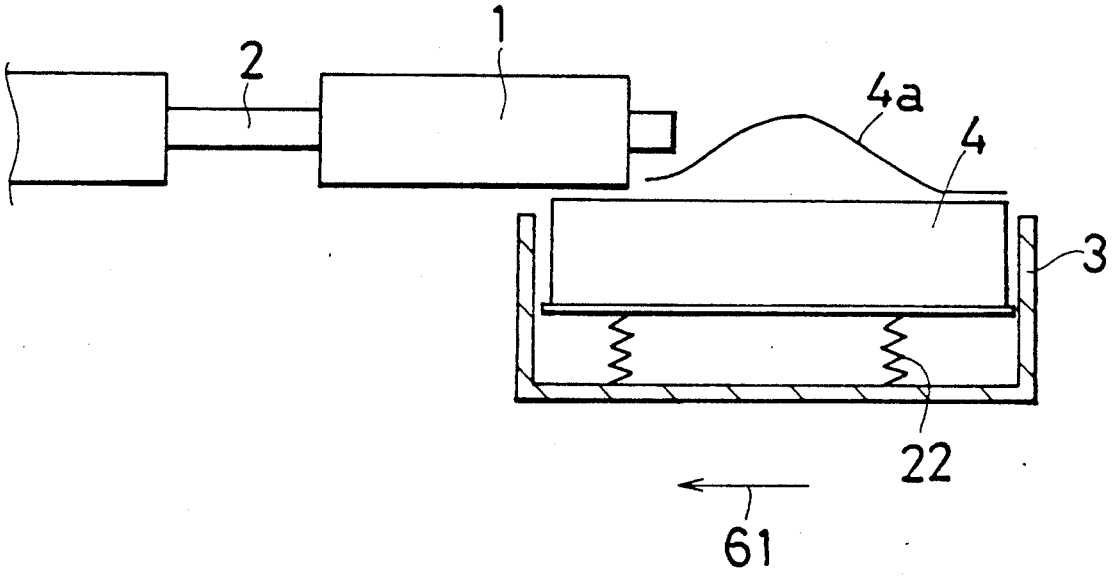
Fig. 1 Prior Art
FIG. 1 is a view showing the inserting state of a paper feeding hopper of a conventional paper feeding apparatus.

Now referring to the drawings, preferred embodiments of the invention are described below.

First Embodiment

Figure 2:
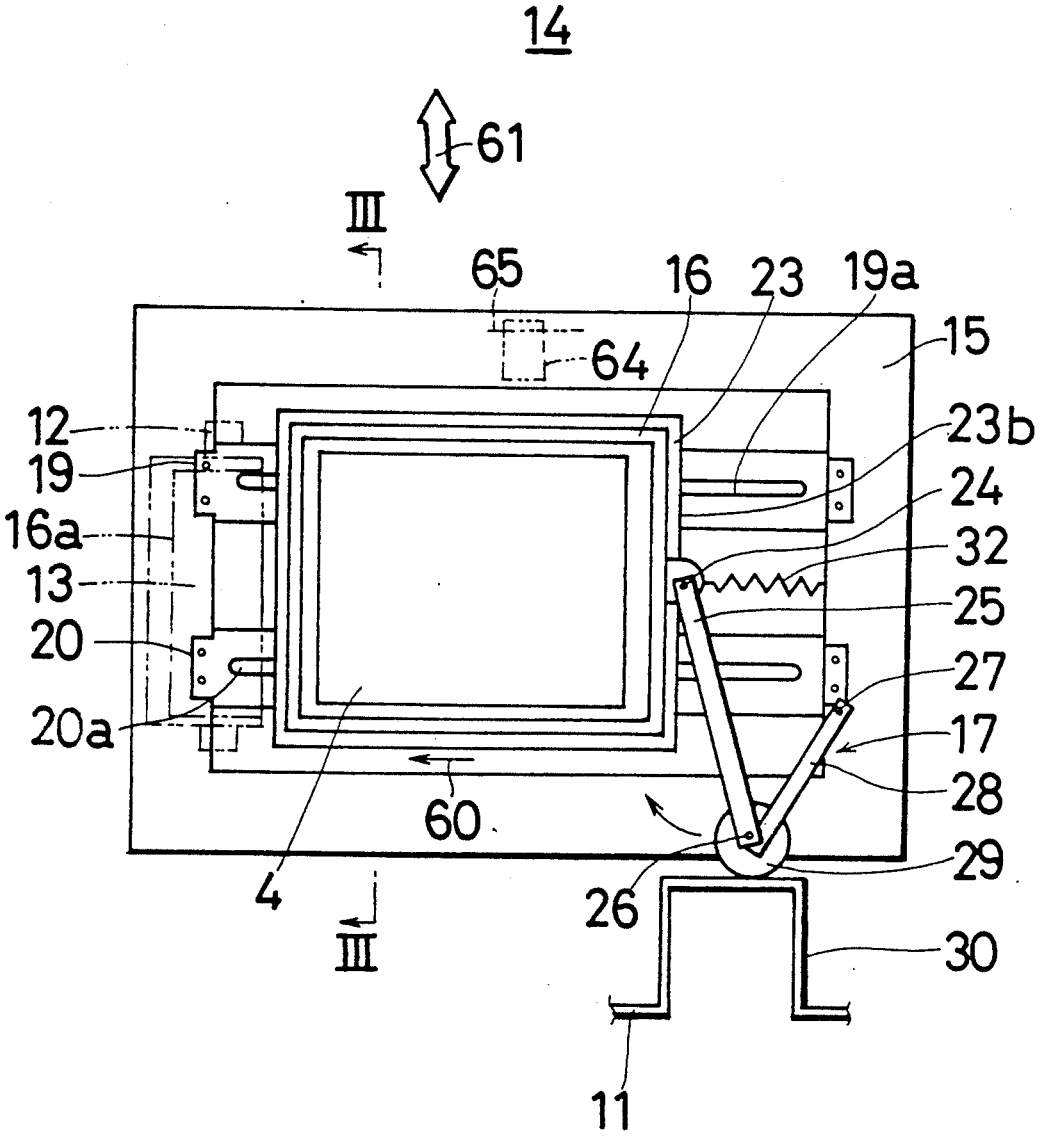
FIG. 2 is a plan view showing a first embodiment of a paper feeding apparatus of an image forming machine according to the invention, FIG. 3(*a*) is a view showing the relationship between the moving direction of a paper feeding hopper and a paper feed roller, FIG. 3(*b*) is a sectional view of a paper feeding hopper portion taken on the plane of the line III-III of FIG. 2.
Figure 3:
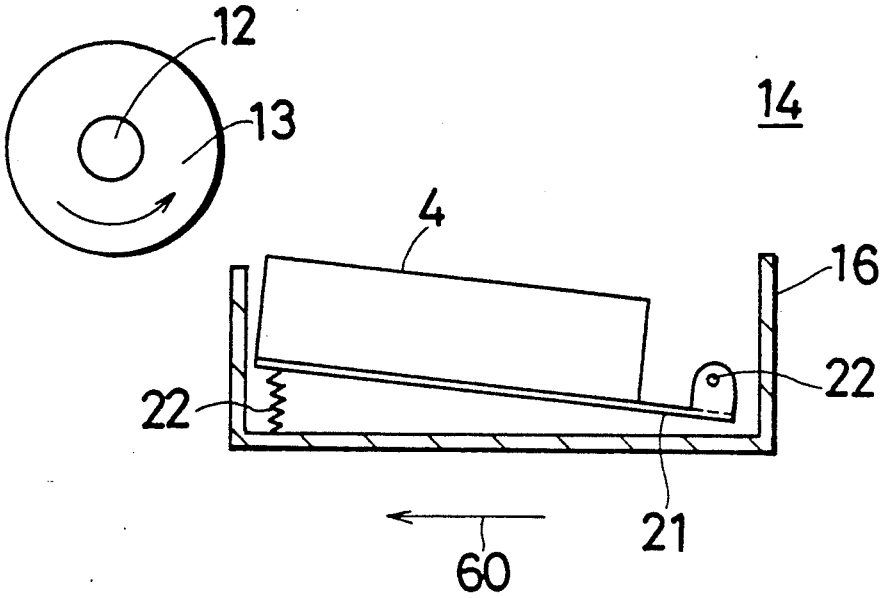
Figure 3:
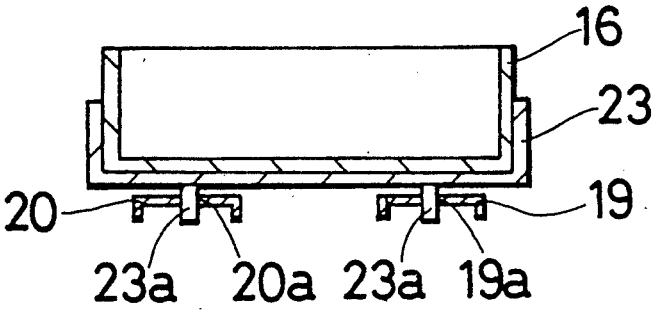

FIG. 2 is a plan view showing a first embodiment of a paper feeding apparatus of an image forming machine according to the invention, FIG. 3(*a*) is a view showing the relationship between the moving direction of a paper feeding hopper and a paper feed roller, and FIG. 3(*b*) is a sectional view of a paper feeding hopper. As shown in the figures, the paper feeding apparatus of the image forming machine of the embodiment comprises, a paper feed roller 13 having a horizontal rotating axis supported by an image forming machine body 11 rotatably via a roller shaft 12, a paper feeding table 15 which can be drawn out freely in the axial direction of the roller shaft 12 from a paper feed opening 14 of the image forming machine body 11, a synthetic resin paper feeding hopper 16 guided and supported by the paper feeding table 15 so as to be movable freely to and from the paper feed roller 13 horizontally, and in a direction orthogonal to the axial direction of the roller shaft 12, and interlocking means 17 which moves the paper feeding hopper 16 to and from the paper feed roller 13 in an interlocking motion with the drawing and restoring operation of the paper feeding table 15.

In the image forming machine body 11 of the copying machine and the like, the opening 14 is formed on the lower front side, and the paper feeding table 15 can be moved freely horizontally in the opening 14 from the front and rear direction 61 (in the vertical direction in FIG. 2).

The paper feed roller 13 is supported rotatably by the image forming machine body 11 at roller shaft 12 having an axis extending in the front and rear direction so as to be positioned above the paper feeding hopper 16 when it is received.

The paper feed roller 13 is constructed to rotate freely when rotating reversely to the paper feeding direction by means of a clutching function such as a latch or the like.

The paper feeding table 15 is, as shown in FIG. 2, formed into a rectangular frame and provided in the center thereof with guide rails 19, 20 having guide holes 19*a*, 20*a* for guide a bottom projection 23*a* of the paper feeding hopper holder 23 to be described later in both right and left directions.

The paper feeding hopper 16 has an open top as shown in FIG. 3 and a table 21 for placing paper 4 thereon is supported by the paper feeding hopper 16 swingably about a shaft 22. A compression coil spring 22 for biasing the plate 21 upward is provided. The paper feeding hopper 16 is received in a hopper-type paper feeding hopper holder 23 having an open top.

The interlocking means 17 comprises, a first link 28 and a second link 25. The second link 25 is connected to a side face 23*b* on the opposite side of the paper feed roller 13 of the paper feeding hopper holder 23 via a pin 24 and the first link 28 is connected at one end to the second link 25 by a pin 26 and to the paper feeding table 15 at the other end by a pin 27. A rotary roller 29 is rotatably supported at a connecting pin 26 of the links 25, 28, and a projection 30 projecting forward behind (lower portion in FIG. 2) the opening 14 of the image forming machine body 11 for contact with the rotary roller 29. By the rotary roller 29 contacting to the projection 30 when the paper feeding table 15 is received, an angle between the links 25 and 28 changes to move the paper feeding hopper 16 toward the paper feed roller 13 or in the direction shown by the arrow 60.

Also, between the paper feeding hopper holder 23 and the paper feeding table 15, a returning spring 32 for detaching the paper feeding hopper 16 from the paper feed roller 13 when the paper feeding table 15 is drawn out is interposed. By the returning spring 32, when the paper feeding hopper 16 is set to the paper feeding position, the paper feeding hopper 16 is retained at the set position by a friction force between the paper feed roller 13 and paper, and when the paper feeding table 15 is drawn out and the plate 21 is detached from the paper feed roller 13, a biasing force just enough to move the paper feeding hopper holder 23 away from the paper feed roller 13 is given.

In the aforesaid configuration, as shown in FIG. 1, when the paper feeding table 15 is moved backward from the front, the projection 30 on the side of the paper feeding table 15 abuts against the rotary roller 29, which moves on the plane of the projection 30, thereby the angle between the first and second links 28 and 25 becomes larger and the paper feeding hopper 16 and the paper feeding hopper holder 23 are moved toward the paper feed roller 13 along the guide rails 19, 20.

At this time, when paper moves from the axial direction and vertical direction of the paper feed roller 13, since a clutching function such as a latch is provided on the paper feed roller 13, it rotates freely reversely to the forward rotating direction which is the paper feeding direction. Therefore, the paper feed roller 13 is rotated as the paper is moved, thus the paper feeding hopper 16 may be received in a predetermined position without slacking of paper.

Since the interlocking means 17 is provided in such a manner, the existing paper feeding hopper 16 may be used. Thus, cost for a metal mold ensuring from a new design of the paper feeding hopper 16 is not necessitated.

Also, the paper feeding hopper 16 is moved in the axial and vertical direction of the paper feed roller 13 (in both right and left directions in FIG. 2), so that the paper feeding hopper 16 may be received in a predetermined position without twisting of paper, preventing the paper feed roller 13 from abutting with paper feeding hopper 16.

Figure 4:
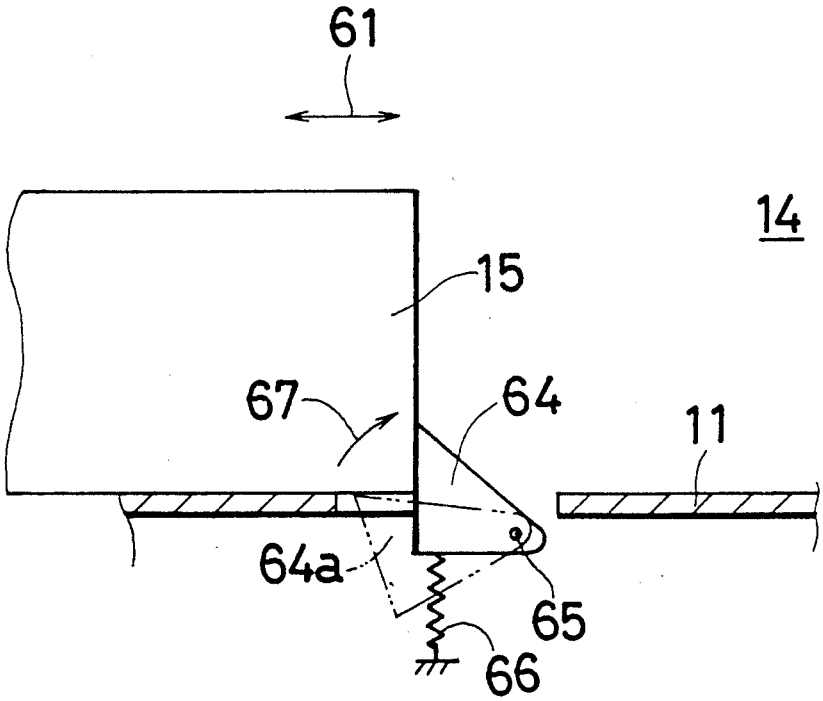
FIG. 4 is a fragmentary sectional view showing a state where a paper feeding table 15 is stopped at a predetermined position for feeding the paper.

FIG. 4 shows a state wherein the paper feeding table 15 is inserted backward (lower portion in FIG. 2, left-hand side in FIG. 4) from the opening 14 to a predetermined position. An engaging claw 64 is mounted on the body 11 so as to be displaceable angularly by means of a pin 65 having an axis parallel to the axial direction of the paper feed roller 13, and biased upwardly by a spring 66. When the paper feeding table 15 is moved leftward from the right side in FIG. 4, the engaging claw 64 is angularly displaced and pressed in by the paper feeding table 15 against the spring force of the spring 66 as shown by reference character 64*a*. When the paper feeding table 15 reaches a predetermined position, the engaging claw 64 is angularly displaced and projected in the direction shown by the arrow 67 by the spring force of the spring 66, thereby the paper feeding table 15 is prevented from returning. Accordingly, even when the spring force of the spring 32 is large, the paper feeding table 15 and the paper feeding hopper 16 are held in the quiescent state at the predetermined position, thus paper may be fed accurately by the paper feed roller 13.

Second Embodiment

Figure 5:
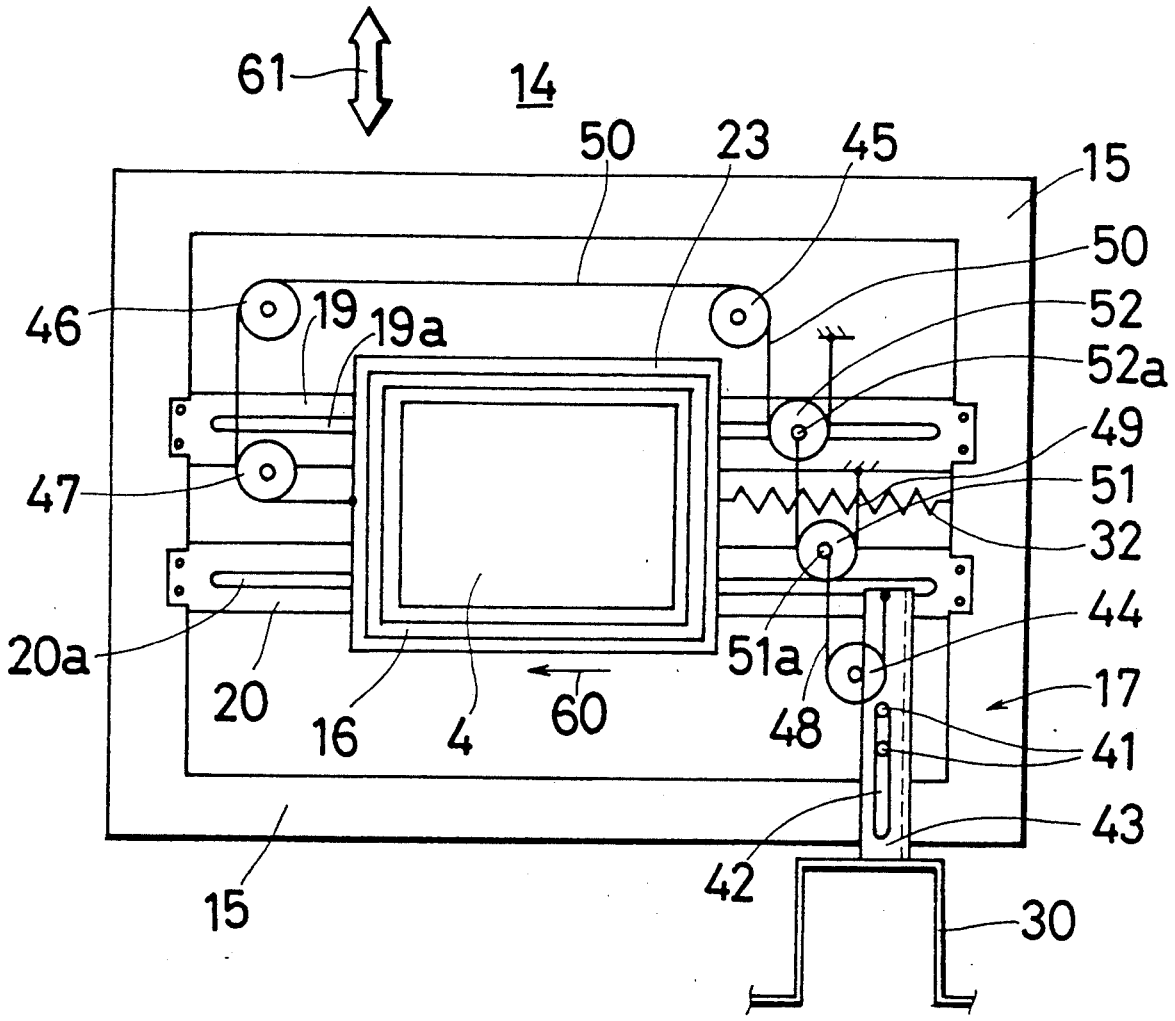
FIG. 5 is a plan view of a paper feeding apparatus showing a second embodiment of the invention.

FIG. 5 is a plan view of a paper feeding apparatus showing a second embodiment of the present invention.

As shown in the figure, an interlocking device 17 of the paper feeding apparatus of the embodiment comprises, a pair of guide pins 41 fixed to a paper feeding table 15, a moving member 43 having a slit 42 and moving back and forth along the pins 41, a projection 30 fixed to an image forming machine body 11 and projecting forward behind an opening 14 for contact with the moving member 43, a plurality of pulleys 44, 45, 46, 47 supported rotatably by the paper feeding table 15, wires 48, 49 50 wound on the pulleys 44 to 47 and movable pulleys 51, 52 which move as the Wires 48 to 50 are moved.

The moving member 43 and the movable pulleys 51, 52 are disposed movably on the paper feeding table 15 in the front and rear direction 61. One end of the wire 48 is connected to the moving member 43 and the other end is connected to a fixed shaft 51*a* of the movable pulley 51. One end of the wires 49, 50 are connected to the paper feeding table 15. The other end of the wire 49 is connected to a fixed shaft 52*a* of the movable pulley 52. The other end of the wire 50 is connected to the paper feeding hopper holder 23. Other configurations are the same as the embodiment shown in FIGS. 2 and 3 described before.

In the aforesaid configuration, when the paper feeding table 15 is moved backward from the opening 14 of the image forming machine body 11, the moving member 43 abuts with the projection 30 fixed to the body 11 and stops, and thereafter, by the paper feeding table 15 moving further backward (lower portion in FIG. 4), the movable pulley 51 is moved backward (lower portion in FIG. 4) by the wire 48, thereby it moves the movable pulley 52 through the wire 49, and finally the paper feeding hopper 16 is moved in the direction of arrow 60 through the wire 50. Incidentally, in this mechanism, when a moving quantity of the moving member 43 is represent by l, the paper feeding hopper 16 is moved by 4.l.

Other operating effects are as same as the first embodiment mentioned above.

It is to be understood that the invention is not limited to the embodiments aforementioned, and that various changes and modifications may be made to the embodiments within the scope of the invention.

For example, as in the aforesaid example, the interlocking means 17 is not limited to those using the link mechanism and pulleys, but other mechanisms may be used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper feeding apparatus for an image forming machine having a paper feed opening, the paper feeding apparatus comprising:

a paper feed roller rotatably supported by a roller shaft on the image forming machine;

a paper feed table freely movable in an axial direction of the roller shaft toward and away from the paper feed opening of the image forming machine;

a paper feed hopper guided and supported by the paper feed table, the paper feed hopper being movable in the axial direction of the roller shaft with the paper feed table and further being movable in a direction generally orthogonal to the axial direction to horizontally move toward and away from the paper feed roller; and interlocking means for moving the paper feed hopper in the direction generally orthogonal to the axial direction in response to movement of the paper feed table.

2. The paper feeding apparatus for an image forming machine as claimed in claim 1, wherein the interlocking means further comprises:

a first link having one end pivotally attached to the paper feeding table by a first pin, the first pin being generally vertical with respect to the axial direction and generally orthogonal to a longitudinal axis of the roller shaft;

a second link having one end pivotally attached to the other end of the first link by a second pin, the second pin being generally parallel to the first pin, the other end of the second link being pivotally attached by a third pin to the paper feed hopper the third pin being generally parallel to the first pin; and stopper means for operatively engaging the other end of the first link and the other end of the second link upon movement of the paper feed table away from the paper feed opening to pivot the first and second link relative to each other to thereby move the paper feed hopper toward the paper feed roller.

3. The paper feeding apparatus for an image forming machine as claimed in claim 2, wherein the interlocking means further comprises a roller rotatable about the second pin, the roller contacting the stopper means during movement of the paper feed table away from the paper feed opening.

4. The paper feeding apparatus for an image forming machine as claimed in claim 2, further comprising a spring between the paper feed table and the paper feed hopper, the spring urging the paper feed hopper away from the paper feed roller when the paper feed table moves toward the paper feed opening.

5. The paper feeding apparatus for an image forming machine as claimed in claim 2, wherein the first and second links form an angle therebetween and wherein the angle between the first and second links increases upon engagement with the stopper means and movement of the paper feed table away from the paper feed opening such that the paper feed hopper moves toward the paper feed roller and wherein the angle between the first and second links decreases upon movement of the paper feed table toward the paper feed opening such that the paper feed hopper moves away from the paper feed roller.

6. The paper feeding apparatus for an image forming machine as claimed in claim 1, wherein the interlocking means further comprises:

a moving member provided on the paper feed table, the moving member being movable in a direction generally parallel to the axial direction of the roller shaft;

at least one fixed pulley mounted on the paper feeding table;

at least one movable pulley displaceable relative to the paper feed table in the direction generally parallel to the axial direction of the roller shaft;

a first wire operatively connected at one end to the moving member and at the other end to the at least one movable pulley;

a second wire operatively connected at one end to the paper feed table and at the other end to the paper feed hopper at a side thereof which is close to the paper feed roller; and stopper means for engaging the moving member upon movement of the paper feed table away from the paper feed opening to move the paper feed hopper toward the paper feed roller via the first wire, the at least one movable pulley, the second wire and the at least one fixed pulley.

7. The paper feeding apparatus for an image forming machine as claimed in claim 6, wherein the second wire extends from the side of the paper feed hopper close to the paper feed roller to a side of the paper feed hopper farthest from the paper feed roller and the second wire is operatively connected to the at least one movable pulley.

8. The paper feeding apparatus for an image forming machine as claimed in claim 7, wherein four fixed pulleys are provided and wherein the second wire engages three of the four fixed pulleys.

9. The paper feeding apparatus for an image forming machine as claimed in claim 6, wherein at least two fixed pulleys and two movable pulleys are provided, the first wire being connected at the other end to a first one of the two movable pulleys and a third wire being provided, the third wire being connected at one end to the paper feeding table and at the other end to a fixed shaft of a second one of the at least two movable pulleys, the third wire engaging the first of the two movable pulleys.

10. The paper feeding apparatus for an image forming machine as claimed in claim 6, further comprising a spring between the paper feed table and the paper feed hopper, the spring urging the paper feed hopper away from the paper feed roller when the paper feed table moves toward the paper feed opening.

11. The paper feeding apparatus for an image forming machine as claimed in claim 1, further comprising guide rails provided on the paper feed table and projections provided on a bottom of the paper feed hopper, the projections being operatively connected to the guide rails and the paper feed hopper being movable in the direction generally orthogonal to the axial direction along the guide rails.

12. The paper feeding apparatus for an image forming machine as claimed in claim 1, further comprising an engaging claw pivotally connected to the image forming machine and means for urging the claw to block movement of the paper feed table in the axial direction of the roller shaft.

13. The paper feeding apparatus for an image forming machine as claimed in claim 1, further comprising a pivotable table provided in the paper feed hopper, the pivotally table receiving paper thereon and being pivotable in a vertical direction to move toward and away from the paper feed roller.

* * * * *